United States Patent [19]

Green et al.

[11] Patent Number: 4,747,519

[45] Date of Patent: May 31, 1988

[54] HANGER SYSTEM FOR A CONTAINER

[75] Inventors: Paul J. Green; Daniel R. Long; Roger E. Schanzle, all of Cincinnati, Ohio

[73] Assignee: The Procter & Gamble Company, Cincinnati, Ohio

[21] Appl. No.: 785,363

[22] Filed: Oct. 7, 1985

[51] Int. Cl.[4] ..... B67D 5/06

[52] U.S. Cl. ..... 222/181; 215/100 R; 248/339

[58] Field of Search ..... 222/181, 180; 248/339, 248/340, 301, 311.2; 215/100 R, 100 A; 206/866

[56] References Cited

U.S. PATENT DOCUMENTS

| | | | |
|---|---|---|---|
| 2,039,394 | 5/1936 | Dalton | 248/340 |
| 3,484,013 | 12/1969 | Speicher | 215/100 R |
| 3,945,060 | 3/1976 | Gargione | 222/181 |
| 4,093,169 | 6/1978 | Winchell | 215/100 A |

*Primary Examiner*—Joseph J. Rolla
*Assistant Examiner*—Kenneth Noland
*Attorney, Agent, or Firm*—Richard C. Witte; John V. Gorman

[57] ABSTRACT

A hanger system for a container is described as comprising the combination of a container having side and bottom walls and a top wall including a dispensing outlet, wherein the bottom wall has a concave portion. A hanger attachment lug is located and fully contained within the concave portion of the bottom wall of the container, and the attachment lug includes a shaft portion which is substantially circular in cross-section and a retention flange extending outwardly from the distal end of the shaft portion. A detachable hanger member includes an attachment clip formed adjacent its lower portion adapted to engage the shaft portion of the attachment lug to detachably and rotatably attach the hanger member to the container. The hanger member includes an upper hook portion which extends upwardly from the attachment clip and is adapted to suspend the container in inverted condition. The hanger member is attachable to the attachment lug from any direction about the periphery of such lug, and, following attachment, is rotatable a full 360° thereabout. The hanger system provides a versatile means of suspending a container in inverted condition from a variety of support structures without impeding conventional manufacturing, shipping and handling characteristics for such container.

6 Claims, 3 Drawing Sheets

Fig. 2
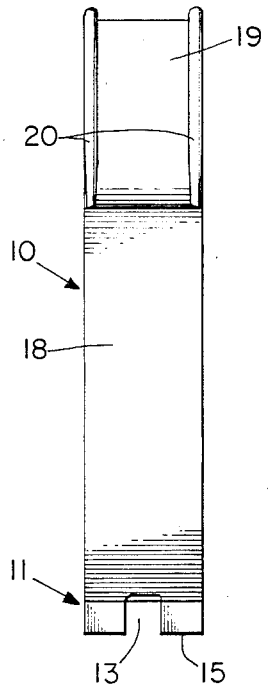
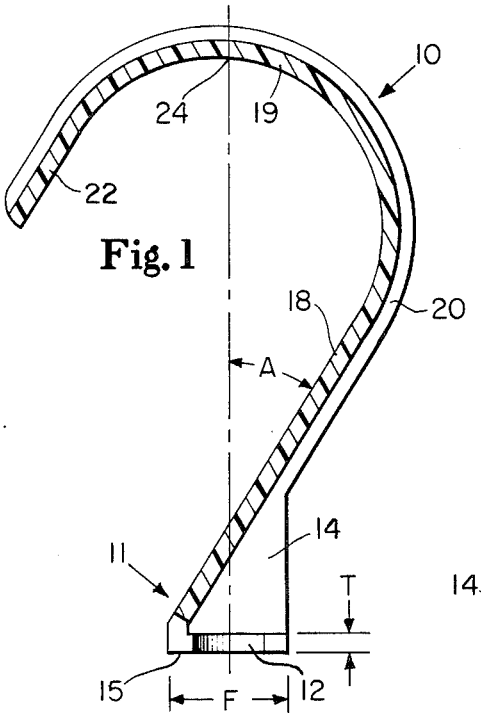
Fig. 1
Fig. 3
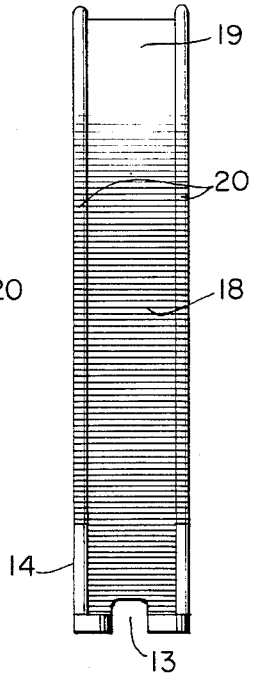
Fig. 4
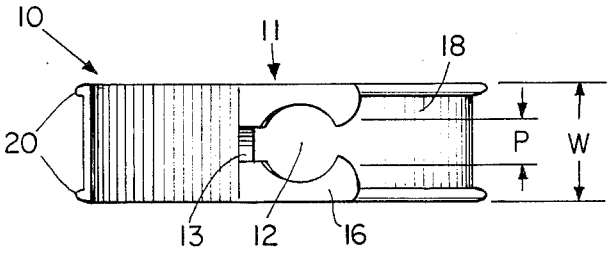

HANGER SYSTEM FOR A CONTAINER

TECHNICAL FIELD

This invention relates to a hanger system for a container, and, more particularly, to a hanger system to support a container in an inverted condition and including a hanger member which detachably engages a hanger attachment lug which is fully contained within a concave portion of the bottom wall of the container.

BACKGROUND ART

Hanging mechanisms and support hooks have been utilized in conjunction with containers and dispensers in various ways in the industry. U.S. Pat. No. 2,760,687, for example, which issued to I. W. Spier et al. on Aug. 28, 1956, discloses a squeeze container including a detachable spout member having a "goose neck" configuration. The shape of the spout is designed to direct the contained liquid downwardly during dispensing operations and to provide hook means for suspending the device for storage. The Spier et al. spout further includes a reservoir located at the end of the downwardly curved portion which is designed to contain a predetermined amount of liquid product to provide a dosed application of such liquid separate from the remainder of the product within the body of the container. Similarly, U.S. Pat. No. 3,495,797, which issued to D. M. Ganz on Feb. 17, 1970, describes a holder for a collapsible tube container, such holder comprising a hook member by which the container may be suspended from a suitable support. The Ganz holder includes a frustoconical body having a depending sidewall designed to fit over a conventional closure cap and to engage therewith. After the holder is fit over the closure cap, the holder/closure cap combination can be removed from the collapsible tube for dispensing and replaced for storage after a dispensing operation.

A dispensing container having a washer-shaped hanger member designed to be coupled to a track for mounting on a bathroom wall is shown in U.S. Pat. No. 4,085,867, which issued to P. Heller on Apr. 25, 1978. The Heller dispenser includes a main product chamber, an integrally formed pump chamber located beneath the main chamber, and a pair of check valves arranged above and below such pump chamber to provide a pump-type dispenser which can be manually squeezed to dispense liquid. On its upper end, the Heller dispenser includes threaded neck portion whereon a cap closure is placed. The cap closure is designed to hold in place the washer-shaped hanger member which includes an upturned bead portion designed to interact with a horizontal hanging track to suspend the dispenser along a vertical surface.

U.S. Pat. Nos. 2,304,547 and 2,362,523, which issued to F. A. Cutter on Dec. 8, 1942 and E. M. Armstrong, Jr. et al. on Nov. 14, 1944, respectively; disclose suspension members for containers, with such suspension members having peripheral channel elements which attach over beads formed along the bottom edge of the containers. Both of these references also contemplate hook means which can be placed in either an extended hanging position or a relatively non-obstructing storage position relative to the bottom surface of the container.

A liquid dispensing bottle hanger is also disclosed in U.S. Pat. No. 3,945,060, which issued to F. Gargione on Mar. 23, 1976. The Gargione bottle has a large circular boss formed on its bottom wall onto which a hanger clip is to be mounted. The hanger clip has a pair of arcuate fingers which circumferentially and slidably engage the circular boss. The Gargione clip is rotatable 90° about the circular boss between stored and hanging positions. When in the stored position, the downwardly extending portion of the clip coincides in face-to-face relationship with a protuberance formed in the lower portions of the dispensing bottle.

U.S. Pat. No. 3,484,013, which issued to W. L. Speicher on Dec. 16, 1969, shows a container having a retractable suspension hook attached to its bottom surfaces. The Speicher container is formed with a concave recess in its bottom wherein a lug is formed. The lug has a central aperture which receives one end of an elongated suspension hook which can be rotated from a stored position within the concave recess of the container bottom to an extended position. A lip is formed on the lug to serve as a retainer for the elongated hook device to retain the hook in its retracted position when desired.

Despite all the prior work done in this area, there remain problems in providing a hanger system which does not interfere with standard manufacturing, shipping and handling procedures associated with the container while allowing convenient suspension of such container in inverted condition from a variety of support structures. With prior art hangers, rotatable adjustability of the hanger member was often limited between stored or hanging positions, thereby limiting the adaptability of the hanger system to various environments. Prior hangers also lacked the ability to easily adjust to various bottle shapes and bottle hanging characteristics.

DISCLOSURE OF THE INVENTION

It is an object of this invention to obviate the above-described problems.

It is another object of the present invention to provide a hanger system for a container, wherein such hanger system comprises an attachment lug located and fully contained within a concave portion of the bottom wall of the container and wherein a detachable hanger member is attachable to such attachment lug from any direction about the periphery of the lug.

It is yet another object of the present invention to provide a hanger system for a container wherein a detachable hanger member is conveniently attachable to such container and rotatable a full 360° while in such attached position to provide adaptability of such hanger system to various bottle shapes, support structures, and environments.

In accordance with one aspect of the present invention, there is provided a hanger system for a container which comprises in combination a container having side and bottom walls and a top wall including a dispensing outlet, with such bottom wall having a concave portion formed therein. A hanger attachment lug is located and fully contained within the concave portion of the bottom wall of the container, and such attachment lug includes a shaft portion which is substantially circular in cross-section and a retention flange extending outwardly from the distal end of the shaft portion. A detachable hanger member has an attachment clip formed adjacent its lower portion adapted to engage the shaft portion of the attachment lug to detachably and rotatably attach the hanger member to the container. The hanger member further includes an upper hook portion which extends upwardly from the attachment clip and is adapted to suspend the container in inverted condition. The hanger member can be attached to the attachment lug from any direction about the periphery of the lug, and, after attachment, is rotatable a full 360° thereabout.

BRIEF DESCRIPTION OF THE DRAWINGS

While the specification concludes with claims particularly pointing out and distinctly claiming the present invention, it is believed that the same will be better understood from the following description taken in conjuction with the accompanying drawings in which:

FIG. 1 is a cross-sectional front elevational view of a preferred hanger member of the hanger system of the present invention;

FIG. 2 is a left side elevational view of the hanger member of FIG. 1;

FIG. 3 is a right side elevational view of the hanger member of FIG. 1;

FIG. 4 is a bottom plan view of the hanger member of FIG. 1;

DETAILED DESCRIPTION OF THE INVENTION

Figure 5:
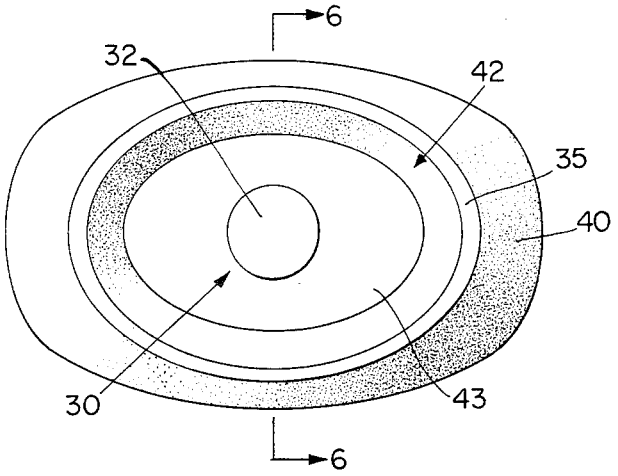
FIG. 5 is a bottom plan view of a container made in accordance with the present invention.
Figure 6:
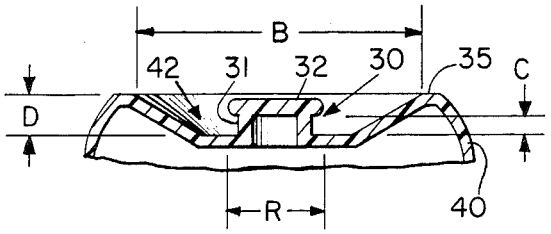
FIG. 6 is a partial, cross-sectional front elevational view of the container shown in FIG. 5 taken along line 6—6 thereof.
Figure 7:
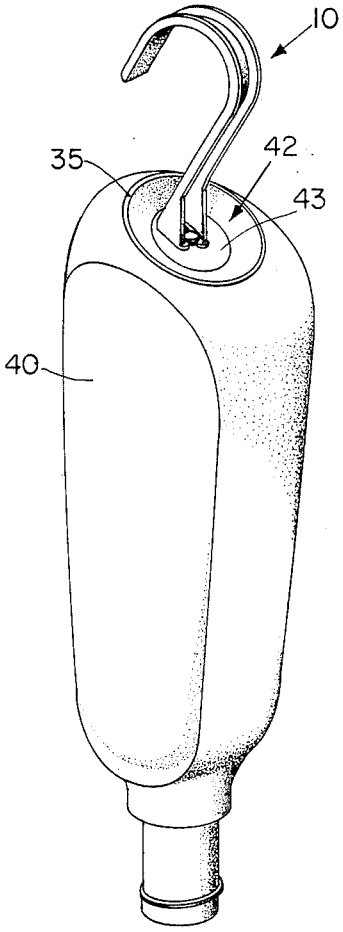
FIG. 7 is a perspective view of a container system made in accordance with the present invention, wherein the hanger member of FIG. 1 has been attached to the container shown in FIGS. 5 and 6.

Referring now to the drawings in detail, wherein like numerals indicate the same element throughout the views, a hanger system for a container is shown in FIGS. 1 through 7 as comprising a detachable hanger member 10 and a hanger attachment lug 30 formed on the bottom of a container or bottle 40. In FIG. 7, bottle 40 is shown as having side and bottom walls and a top wall which includes a dispensing outlet. The bottom wall of bottle 40 includes a concave or recessed portion 42 surrounded about its periphery by a non-concave portion 35. While bottle 40 can be made of any material commonly used to form containers for various products, it is preferred that bottle 40 be made from a thermoplastic resin for ease in manufacture.

FIGS. 5 and 6 illustrate the bottom portions of a bottle 40 which has been modified in accordance with the present invention. Located within the concave portion 42 is a hanger attachment lug 30, which further comprises a shaft portion 31 preferably having a substantially circular cross-section, and a disk-like retention flange 32 which extends outwardly about the periphery of the distal end of the shaft portion 31. It is contemplated that shaft portion 31 could have a cross-section which includes one or more flat or otherwise non-circular portions (e.g. shaft portion 31 might have an octagonal cross-section with adjacent flat areas about its periphery); however, it is preferred to make shaft portion 31 more circular to facilitate rotation of hanger member 10, as will be discussed further below. Such cross-section is referred to as substantially circular to indicate that, even if some portions of the outer surface of shaft 31 are flat or otherwise non-circular, hanger member 10 can still be relatively conveniently rotated a full 360° thereabout. As used herein, the term "substantially circular in cross-section" shall include shaft portions having one or more flat or otherwise non-circular portions about which hanger member 10 can be rotated.

Attachment lug 30 extends longitudinally outwardly from the recessed wall portion 43 of the bottom wall of bottle 40, and is fully contained within the concave portion 42 such that no part of attachment lug 30 extends longitudinally outwardly beyond the peripheral non-recessed portion 35. By insuring that the attachment lug is fully contained within concave portion 42, bottle 40 can be placed in a stable upright position for standard manufacturing, shipping, and storage procedures, being supported on its lower edge by the non-concave portions 35 of its bottom wall. In this way, bottle 40 retains the shipping, handling and storage characteristics of common containers.

FIGS. 1 through 4 illustrate a preferred detachable hanger member 10 of the subject invention which includes an attachment clip 11 formed adjacent its lower portion and a generally U-shaped upper hook portion 19 which extends upwardly from the attachment clip 11. Attachment clip 11 is adapted to engage hanger attachment lug 30 below retention flange 32 to detachably and rotatably attach hanger member 10 to bottle 40. In particular, attachment clip 11 includes a substantially flat bottom surface 15 further comprising a pair of oppositely disposed claw sections 16 defining a substantially U-shaped open portion 12 therebetween. Claws 16 are designed to resiliently deform outwardly a sufficient amount to permit attachment clip 11 to be snapped around the shaft portion 31 of hanger attachment lug 30 below retention flange 32. In this regard, open section 12 of attachment clip 11 preferably conforms in size and shape to the outer surface of shaft portion 31 to provide a relatively snug fit when snapped thereover. In fact, it is also preferred to make the area of open section 12 of a slightly smaller diameter than the outer dimension of shaft 31 to provide a snug frictional interactive fit therebetween. Where the substantially circular cross-section of shaft 31 includes one or more flat or otherwise non-circular portions, the inner surfaces of open section 12 might be formed with complementary portions to provide one or more preset hanger positions about shaft 31.

While the material from which hanger member 10 is made is not critical, such material must provide sufficient hanger strength to safely support bottle 40 and its contained product, and must be sufficiently resilient to enable the claws 16 to spring apart far enough to snap around shaft portion 31 without breaking or permanently deforming. In this regard, a designed weakening slot or stress area 13 can be provided in attachment clip 11 to facilitate such resilience and spring action. Polystyrene (such as high impact polystyrene #760, available from American Hoechst of Leominster, MA) is a good example of material which can provide a hanger member 10 featuring the required strength and resilience discussed herein. Utilization of a weakened area or slot 13 allows relatively stiff claws 16 to move outwardly around the shaft portion 31 as hook member 10 is snapped onto attachment lug 30. Support walls 14 add strength and rigidity to attachment clip 11 by connecting the outer edges of claw sections 16 with the upwardly extending stem 18 of hanger member 10. Stem 18 extends between attachment clip 11 and a generally U-shaped upper hook portion 19 which is adapted to suspend bottle 40 from a variety of support structures (not shown) such as shower curtain rods and the like.

In FIGS. 1 through 4, hanger member 10 is shown as including upstanding edges 20 providing a substantially channel-like structure thereto. In this regard, it is preferred to reinforce hanger member 10 by utilizing reinforcing ribs such as edges 20, thereby conserving material yet providing sufficient strength and rigidity to the structure. Any combination of materials and specific hanger structure, however, can be utilized to ensure sufficient strength and rigidity of hanger member 10. Stem 18 extends upwardly from attachment clip 11 and is attached at its upper end to the generally U-shaped upper hook portion 19, which is adapted to suspend a container or bottle 40 in inverted condition. The U-shaped hook portion 19 can feature a variety of shapes and diameters of its curvatures according to specific characteristics of various support structures onto which the hanger member will be hooked. For manufacturing ease it is preferred that the distal end 22 of hook portion 19 feature a structure which is substantially parallel to stem 18. It is also contemplated that hanger member 10 might include extra material in predetermined specific portions in order to balance the hanger system as desired. For example, it is preferred that hanger member 10 be designed such that its geometry and material distribution allows it to independently hang in a stable condition on a support structure when not attached to a container. This is preferred to further enable disposal of exhausted containers and hanging storage of a reusable detachable hanger member 10 between its use in conjunction with another container made in accordance herewith.

It is also preferred that the placement of hanger attachment lug 30 within the concave portion 42 of a bottle 40 be chosen to align the center line of a hanger member 10 with the center of gravity of the container, thereby providing a hanger system which will allow the container to hang in a substantially vertical manner. To insure that a particular container will hang in a substantially vertical manner, it is imperative that the point, or center of a line, of contact (labeled as point 24 in FIG. 1) of hanger member 10 be aligned with the center of open section 12 along a line parallel to the longitudinal axis of bottle 40 and passing through the center of gravity thereof. For example, for a symmetrical bottle the point of contact 24 and the center of section 12 should be aligned along the central axis of the bottle. The angle A at which stem 18 is oriented relative to the longitudinal axis of the hanger member 10 can be varied as desired, however, hook contact point 24 and the center of open section 12 must be aligned as described above if vertical orientation of the suspended container is desired.

As an example of a hanger system made in accordance herewith, a substantially standard blow-molded thermoplastic container (as shown in the perspective view of FIG. 7) was made having a concave portion 42 formed in its bottom wall, and having a hanger attachment lug 30 located and fully contained within concave portion 42. The depth D of concave portion 42 was approximately 3.2 mm (0.126 inches). Attachment lug 30 was located centrally within concave portion 42, having a shaft portion 31 with an outside diameter of approximately 6.35 mm (0.250 inches) and having a retention flange 32 approximately 1.14 mm (0.045 inches) in thickness and approximately 7.62 mm (0.300 inches) in outside diameter (R) formed on the distal end of such shaft portion. Shaft portion 31 and retention flange 32 extended longitudinally outwardly from the substantially flat portion 43 of concave portion 42 approximately 2.59 mm (0.102 inches; i.e. the vertical height C of shaft portion 31 was approximately 1.45 mm), thereby being fully contained within the recess thereof. It is contemplated that bottle 40 can be made of any moldable material such as polyethylene, polypropylene and other appropriate thermoplastics. Although glass could be used, it is not preferred due to the obvious safety concerns and potential manufacturing difficulties.

A detachable hanger member 10 was formed of polystyrene material (as mentioned above), as illustrated and described above in FIGS. 1 through 4. Hanger member 10 was formed with an overall width W of approximately 10.2 mm (0.400 inches) and having a thickness in hook portion 19 and stem 18 of approximately 1.02 mm (0.04 inches). Upstanding reinforcing edges 20 extended outwardly from opposite edges of the outer surfaces of upper hook member 19 and stem 18 approximately 3.18 mm (0.125 inches) and had a width of approximately 1.2 mm (0.047 inches). The overall height of hanger member 10 from lower surface 15 to the hanging contact point 24 was approximately 45.5 mm (1.792 inches), and the upper hook portion 19 included an inside radius of its curved portion of approximately 14.3 mm (0.562 inches). Attachment chip 11 included a bottom surface 15 comprising oppositely disposed attachment claws 16 having a thickness (T) of approximately 1.3 mm (0.050 inches) and having a length (F) and width of approximately 10.2 mm (0.400 inches), thereby creating a substantially square and flat bottom surface 15. A centrally located open section 12 was formed in bottom section 15 with a diameter of approximately 6.32 mm (0.249 inches). The oppositely disposed claws 16 were separated by an opening between their distal edges of approximately 3.3 mm (0.130 inches), and such distal edges were rounded to facilitate the attachment of attachment clip 11 around attachment lug 30, as described above. A semicircular weakening slot 13 was located in the lower portion of stem 18 extending from the open section 12 to provide additional resilience to attachment clip 11, with such slot having an approximate radius of 1.65 mm (0.065 inches). Reinforcement walls 14 were formed as extensions of upstanding reinforcement edges 20, having a thickness of approximately 1.2 mm (0.047 inches) and extending substantially vertically to connect such edges 20 with the upper surfaces of claws 16, thereby reinforcing the connection between attachment clip 11 and stem 18. The exact dimensions of such reinforcing walls 14 are not critical, and are illustrated in the figures as approximately aligning along their vertical distal edge with the distal edge of the attachment claws 16. As mentioned above, for manufacturing ease it is preferred that the distal end of the upper hook portion 19 extend substantially parallel to stem 18. In this example, the distal 8.56 mm (0.337 inches) of hook portion 19 was formed relatively straight and substantially parallel to the straight portion of stem 18. Stem 18 was oriented at an angle A of approximately 39° relative to the center line of hanger member 10. The resulting hanger system provided a detachable hanger member attachable to the attachment lug of the dispensing container from any direction about the periphery thereof, and, once attached to the lug, rotatable 360° thereabout to suspend the container in any such rotated position.

In order to determine required dimensions for various portions of a hanger system made in accordance herewith, it is preferred to first determine the approximate size of the hanger member, attachment clip and attachment lug relative to the materials from which such parts are to be made to determine minimum dimensional requirements necessary to provide sufficient strength for a safe hanger system. Once a diameter R of the attachment lug has been chosen, a corresponding attachment clip length F can next be similarly chosen, as well as the depth D of concave portion 42. While these dimensions can be varied as desired, they each have a minimum which is based on strength and molding requirements. The minimums can be utilized to determine the minimum required diameter B of concave portion 42 of a bottle necessary to achieve the characteristics described in the subject disclosure.

In particular, the following formula can be utilized to roughly determine the minimum diameter of the concave portion 42 of a bottle 40 required to achieve the desired attachment and rotatability features of the subject hanger system for a given depth D of recessed portion 42, and a given length F of attachment clip 11.:

$$\frac{B}{2} \geqq \sqrt{\left(\frac{R}{2}\right)^2 - \left(\frac{P}{2}\right)^2} + \sqrt{F^2 - D^2} - \left[\left(\frac{\sqrt{F^2 - D^2}}{D}\right)\left(C - \frac{FT}{\sqrt{F^2 - D^2}}\right)\right]$$

wherein:

F is the length of attachment clip 11;
D is the depth of concave portion 42 of bottle 40;
C is the vertical height of shaft portion 31;
T is the thickness of claw portions 16;
B is the minimum diameter of recessed portion 42;
R is the diameter of retention flange 32; and
P is the width between the two points where the upper surface of attachment claws (e.g. 16) of a hanger member first contact the lower surface of the attachment lug retention flange (e.g. 32) during an attachment procedure.

It is preferred that where bottom edge 15 of attachment clip 11 is formed as a substantially flat surface, there be a corresponding substantially flat surface 43 formed on the bottom wall of bottle 40 to contact and lend stability and support to edge 15. In order to provide such support and to permit full 360° rotation of hanger member 10 about attachment lug 30, flat surface 43 must have a minimum cross-width dimension sufficient to allow the most distal portion of bottom edge 15 unimpeded rotation about lug 30. Such minimum cross-width dimension is generally equal to two times the distance from the center of open section 12 to the most distal point on flat surface 15. For example, in the above illustration, the minimum diameter of flat portion 43 would be about 14.37 mm (0.566 inches). As with all of the dimensions discussed, however, the resilience and deflectability of the materials used in the components of the subject hanger system can provide some leeway or tolerance in the exact dimensions of such structures.

Figure 8:
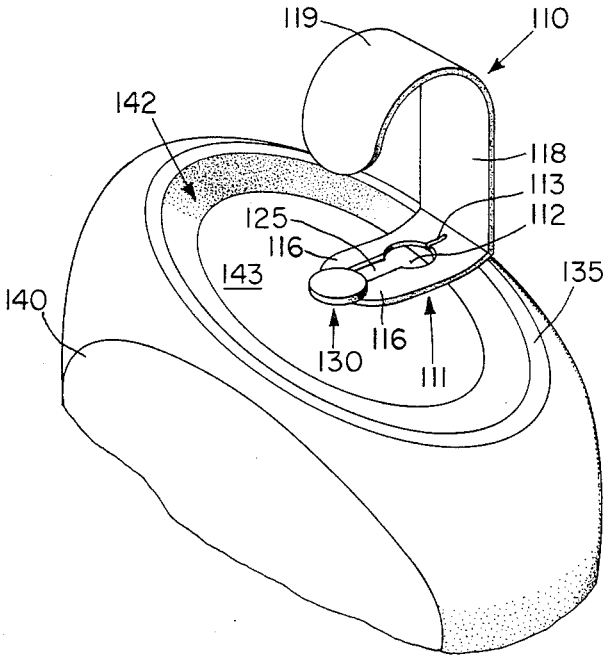
FIG. 8 is a partial perspective view of an alternate embodiment of a hanger system made in accordance with the present invention illustrating the attachment of an alternate embodiment of a hanger member onto a container.

A portion of an alternative embodiment of the hanger system of the subject invention is shown in FIG. 8. Specifically, detachable hanger member 110 is shown as comprising a relatively flat stem 118 connected on its upper end to a generally U-shaped hook portion 119 and at its lower end to attachment clip 111. As described above with regard to attachment clip 11, attachment clip 111 includes an open portion 112 defined by two oppositely disposed attachment claws 116 separated at their distal ends by open space 125, and having a weakening slot 113 formed adjacent its inner edge to provide additional resilience to the attachment clip. Hanger stem 118 is shown as extending substantially in a vertical direction from the back edge of attachment clip 111, and the distal end of hook portion 119 extends downwardly substantially vertically and parallel to stem 118.

FIG. 8 illustrates that hanger member 110 is to be snapped around an attachment lug 130 in a manner substantially identical to that described above to suspend a container in inverted condition. Container 140 is shown as including a concave portion 142 in its bottom wall having a substantially flat portion 143 featuring sufficient area to permit 360° rotation of hanger member 110 about attachment lug 130 after its attachment thereto. Again, the minimum dimensions of concave portion 142 can be generally determined by the equation above, and the minimum area of the substantially flat area such as 143 corresponds proportionally to the dimensions of the bottom surface of the attachment clip 111.

Figure 9:
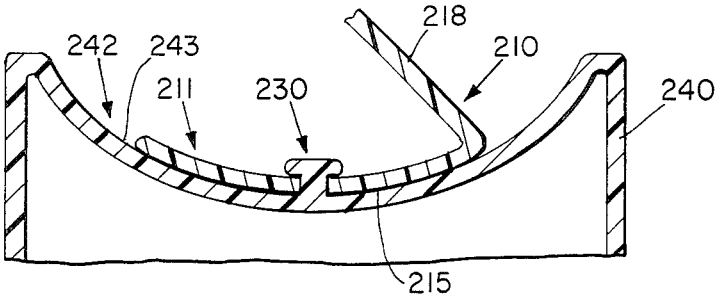
FIG. 9 is a partial cross-sectional front elevational view of a third embodiment of a hanger system made in accordance with the present invention, and showing another hanger member attached to an attachment lug of a container.

FIG. 9 illustrates another embodiment of the subject hanger system wherein the attachment clip 211 of hanger member 210 is shown in its attached position around attachment lug 230 within the concave portion 242 of the bottom wall of container 240. Specifically, container 240 includes a concave portion 242 in its bottom wall wherein hanger attachment lug 230 is fully contained. The area 243 of the concave portion of bottle 240 immediately surrounding attachment lug 230, however, is not substantially flat in conformation, as described above relative to the other embodiments discussed herein. Area 243 is shown as being similarly concaved in relation to the balance of concave portion 242 of container 240. Correspondingly, the lower surface 215 of attachment clip 211 includes an outer conformation substantially corresponding to the non-flat conformation of area 243. These corresponding non-flat areas are designed to contact one another to provide stability to hanger member 210 when attachment clip 211 is snapped around attachment lug 230, while at the same time allowing full 360° rotation of hanger member 210 about attachment lug 230. In this regard, it is contemplated that area 243 immediately surrounding attachment lug 230 could be formed as virtually any non-planar surface (e.g. concave, convex, etc.), wherein the lower surface 215 of an attachment clip 211 features an outer conformation substantially corresponding to such non-planar area to provide stability to the attached hanger member while allowing full rotation thereof about the attachment lug.

Other modifications of the hanger system of the current invention could also be made to adapt the system to any specific environment. For example, the stem portion of the detachable hanger member described herein can be lengthened or shortened as desired, and the angle at which it is attached to its attachment clip can be modified to accommodate suspension of a container from particular support devices. Accordingly, having shown and described the preferred embodiment of the present invention, further adaptions of the hanger system can be accomplished by appropriate modifications by one of ordinary skill in the art without departing from the scope of the present invention. Therefore, the scope of the present invention should be considered in terms of the following claims and is understood not to be limited to the details of structure and operation shown and described in the specification and drawings.

What is claimed is:

1. A hanger system for a container, said hanger system comprising in combination:

(a) a container having side and bottom walls and a top wall including a dispensing outlet, said bottom wall having a concave portion and a centrally located substantially flat area within said concave portion;

(b) a hanger attachment lug located centrally within said flat area and being fully contained within said concave portion of said bottom wall of said container, said hanger attachment lug having a shaft portion which is substantially circular in cross-section and a retention flange extending outwardly from the distal end of said shaft portion; and (c) a detachable hanger member having an attachment clip formed adjacent its lower portion adapted to engage the outer periphery of said shaft portion of said attachment lug below said retention flange to detachably and rotatably attach said hanger member to said container, and having a generally U-shaped upper hook portion extending upwardly from said attachment clip and being adapted to suspend said container in inverted condition, the lower surface of said attachment clip being substantially flat and corresponding to said flat portion of said bottom wall, said hanger member being attachable to said attachment lug from any direction about the periphery thereof, and once attached to said lug, being rotatable 360° thereabout to suspend said container in any such rotated position.

2. The hanger system of claim 1, wherein said substantially flat portion of said bottom wall provides sufficient area to permit substantially unimpeded rotation of said hanger member about said attachment lug.

3. A hanger system for a container, said hanger system comprising in combination:

(a) a container having side and bottom walls and a top wall including a dispensing outlet, said bottom wall having a concave portion;

(b) a hanger attachment lug located and fully contained within said concave portion of said bottom wall of the container, said hanger attachment lug having a shaft portion which is substantially circular in cross-section and a retention flange extending outwardly from the distal end of said shaft portion, the area of said bottom wall immediately surrounding said hanger attachment lug being non-flat in conformation; and (c) a detachable hanger member having an attachment clip formed adjacent its lower portion adapted to engage the outer periphery of said shaft portion of said attachment lug below said retention flange to detachably and rotatably attach said hanger member to said container, and having a generally U-shaped upper hook portion extending upwardly from said attachment clip and being adapted to suspend said container in inverted condition, the lower surface of said attachment clip being non-flat in conformation to correspond to the non-flat portion of said bottom wall surrounding said attachment lug, said hanger member being attachable to said attachment lug from any direction about the periphery thereof, and once attached to said lug, being rotatable 360° thereabout to suspend said container in any such rotated position.

4. The hanger system of claim 3, wherein said non-flat portion of said bottom wall is concave in shape, and wherein the lower surface of said attachment clip is convex in shape to correspond to said non-flat portion of said bottom wall, such surfaces contacting one another when said hanger member is attached to said attachment lug to provide stability to said hanger member while permitting full 360° rotation thereof.

5. A hanger system for a container, said hanger system comprising in combination:

(a) a container having side and bottom walls and a top wall including a dispensing outlet, said bottom wall having a concave portion and one or more non-concave portions;

(b) a hanger attachment lug located and fully contained within said concave portion of said bottom wall of said container, said hanger attachment lug extending outwardly from said bottom wall within said concave portion thereof and having a shaft portion which is substantially circular in cross-section and a retention flange extending outwardly from the distal end of said shaft portion, said bottom wall including a substantially flat area immediately surrounding said hanger attachment lug;

(c) a detachable hanger member having an attachment clip formed adjacent its lower portion adapted to engage the outer periphery of said shaft portion of said attachment lug below said retention flange to detachably and rotatably attach said hanger member to said container, said attachment clip having a substantially flat bottom surface which contacts and rests upon said flat area of said bottom wall when said hanger member is engaged on said attachment lug, said hanger member having a generally U-shaped upper hook portion extending upwardly from said attachment clip and being adapted to suspend said container in inverted condition, said hanger member being attachable to said attachment lug from any direction about the periphery thereof, and once attached to said lug, being rotatable 360° thereabout to suspend said container in any such rotated position, and (d) wherein said container can be placed in a stable upright position being supported by the non-concave portions of its bottom wall only when said hanger member is detached from said hanger attachment lug.

6. A hanger system for a container, said hanger system comprising in combination:

(a) a container having side and bottom walls and a top wall including a dispensing outlet, said bottom wall having a concave portion and one or more non-concave portions;

(b) a hanger attachment lug located and fully contained within said concave portion of said bottom wall of said container, said hanger attachment lug extending outwardly from said bottom wall within said concave portion thereof and having a shaft portion which is substantially circular in cross-section and a retention flange extending outwardly from the distal end of said shaft portion; said bottom wall having an area immediately surrounding said hanger attachment lug which is not substantially flat in conformation;

(c) a detachable hanger member having an attachment clip formed adjacent its lower portion adapted to engage the outer periphery of said shaft portion of said attachment lug below said retention flange to detachably and rotatably attach said hanger member to said container, said attachment clip having a lower surface having an outer conformation substantially corresponding to the non-flat conformation of said area of said bottom immediately surrounding the attachment lug, said corresponding surfaces of said attachment clip and said bottom wall contacting one another and providing stability to said hanger member when said attachment clip is attached to said attachment lug, said hanger member having a generally U-shaped upper hook portion extending upwardly from said attachment clip and being adapted to suspend said container in inverted condition, said hanger member being attachable to said attachment lug from any direction about the periphery thereof, and once attached to said lug, being rotatable 360° thereabout to suspend said container in any such rotated position; and (d) wherein said container can be placed in a stable upright position being supported by the non-concave portions of its bottom wall only when said hanger member is detached from said hanger attachment lug.

* * * * *